US005378049A

United States Patent [19]

Fleischhaker et al.

[11] Patent Number: 5,378,049

[45] Date of Patent: Jan. 3, 1995

[54] ROTARY CUTTER FOR EXTRACTING HARD ROCK

[75] Inventors: Wolfgang Fleischhaker, Bad Schwartau; Joachim Mett, Lübeck, both of Germany

[73] Assignee: Krupp Fördertechnik GmbH, Duisburg, Germany

[21] Appl. No.: 84,214

[22] PCT Filed: Jun. 23, 1992

[86] PCT No.: PCT/EP92/01410

§ 371 Date: Aug. 23, 1993

§ 102(e) Date: Aug. 23, 1993

[87] PCT Pub. No.: WO93/01392

PCT Pub. Date: Jan. 21, 1993

[30] Foreign Application Priority Data

Jul. 13, 1991 [DE] Germany ..... 4123307

[51] Int. Cl.[6] ..... E21C 25/16; E21C 47/00

[52] U.S. Cl. ..... 299/89; 37/91; 37/96; 37/190; 299/39

[58] Field of Search ..... 299/39, 89; 37/91, 94, 37/95, 96, 189, 190, 465

[56] References Cited

U.S. PATENT DOCUMENTS

| | | | |
|---|---|---|---|
| 3,680,919 | 8/1972 | Rear et al. | 299/39 |
| 3,729,231 | 4/1973 | Evans | 37/95 X |
| 3,967,854 | 7/1976 | Posciri | 299/89 X |
| 4,755,004 | 7/1988 | Palmquist et al. | 299/91 |
| 4,979,781 | 12/1990 | Bothwell et al. | 299/18 |

FOREIGN PATENT DOCUMENTS

| | | | |
|---|---|---|---|
| 1331278 | 5/1963 | France | 37/96 |
| 10487 | 3/1941 | Germany . | |
| 3031496A1 | 3/1982 | Germany . | |
| 3822200A1 | 1/1990 | Germany . | |

OTHER PUBLICATIONS

41/0618 d1 038910 from Krupp Industrietechnik [Industrial Technology] GmbH, (undated).

Glückauf [Good Luck ] 117 (1981), No. 15, p. 926.

R. Sager et al., Weinterentwicklung der kontinuierlichen Tagebautechnologie für festere Materialien[2], Mar. 1990.

*Primary Examiner*—David J. Bagnell

*Attorney, Agent, or Firm*—Spencer, Frank & Schneider

[57] ABSTRACT

A disc-shaped rotary cutter for continuous excavation of hard mineral rock layers according to the invention includes a supporting element having a plurality of end faces and a plurality of cutting elements formed on a circumference of the supporting element and the plurality of end faces. According to the invention, the rotary cutter provides a cylindrical compressive strength of equal to or greater than 20 MPa.

8 Claims, 1 Drawing Sheet

ROTARY CUTTER FOR EXTRACTING HARD ROCK

BACKGROUND OF THE INVENTION

1. Field of the Invention

The invention relates to the use of a disc-shaped rotary cutter for excavating hard mineral rock layers.

2. Description of the Related Art

DE-OS [German Unexamined Published Patent Application] 3,822,200 discloses a method of excavating limestone (marl) in which the limestone is produced directly in small sized grains in one process phase during the excavation in essentially a grain size that can be transported on a conveyor belt. The preferred excavator employed is a bucket wheel excavator. Although bucket wheel excavators are now available that can be used in harder rock layers, their performance is limited if they are of conventional configuration, particularly when considering the wear that occurs at the cutting elements. Beginning with a certain rock hardness, conventional methods must be employed, such as drilling, blasting, excavation by a mechanical shovel, loading onto trucks or transporting by rail, breaking up the essential limestone component as well as transporting it further on conveyor belt systems. The multitude of process steps performed from excavation to conveyor belt transport results not only in great delays but also in a relatively small throughput with high costs for materials and personnel. Due to the blasting, the material remains in large pieces and must be almost all fed into a crusher before it can be transported further.

East German Patent 10,487 discloses an excavator for digging small trenches by cutting blades that are disposed at blade supports of a pivotal wheel disc and guide rings that are provided on both sides of the cutting blades. The blade holders and the cutting blades are alternatingly fastened to one side of the blade supports. This type of excavator, which is also known as a trench cutting machine, is provided exclusively to produce trenches of a relatively small width and depth (depending on the diameter), with generally no hard rock layers being involved, but rather loose soil or clay, so that no high demands are made with respect to wear of the cutting elements.

SUMMARY OF THE INVENTION

It is the object of the invention to conceive a continuous process that operates economically and with which hard rock can be excavated without blasting while substantially avoiding a crushing process.

This is accomplished by the use of a disc-shaped rotary cutter for hard mineral rock layers. The cutter has a cylinder compressive strength of equal to or greater than 20 MPa, with the cutter being provided with a plurality of cutting elements at its circumference and also at its end faces. Disc-shaped cutters are generally employed for chip removing work on materials, particularly metals, with these disc-shaped cutters being employed exclusively for cutting grooves or faces. Broader applications have not been disclosed to date.

By using the advantageous cutting technology known for disc-shaped cutters as employed for metals for the cutting wheels of, in particular, bucket wheel excavators, it is now possible to also employ them for harder rocks requiring cylinder compressive strengths of equal to or greater than 20 MPa with acceptable wear of the cutting tools. The expensive, otherwise conventional work of blasting can consequently be substantially avoided.

Advantageous modifications of the subject matter of the invention are disclosed in the following specification and claims.

Examples for hard rock that can be excavated are limestone, clay stone, sandstone and hard coal. The large number of cutting elements on the circumference of the rotary cutter with an appropriate arrangement of the teeth in conjunction with the relatively high installed driving power produce, on the one hand, a very quiet run and, on the other hand, a corresponding fineness of the excavated rock, thus essentially eliminating the necessity of subsequently connected crushing systems.

BRIEF DESCRIPTION OF THE DRAWINGS

One embodiment of the invention is illustrated in the drawing figures and will be described as follows. In the drawing figures.

DESCRIPTION OF THE PREFERRED EMBODIMENT

Figure 1:
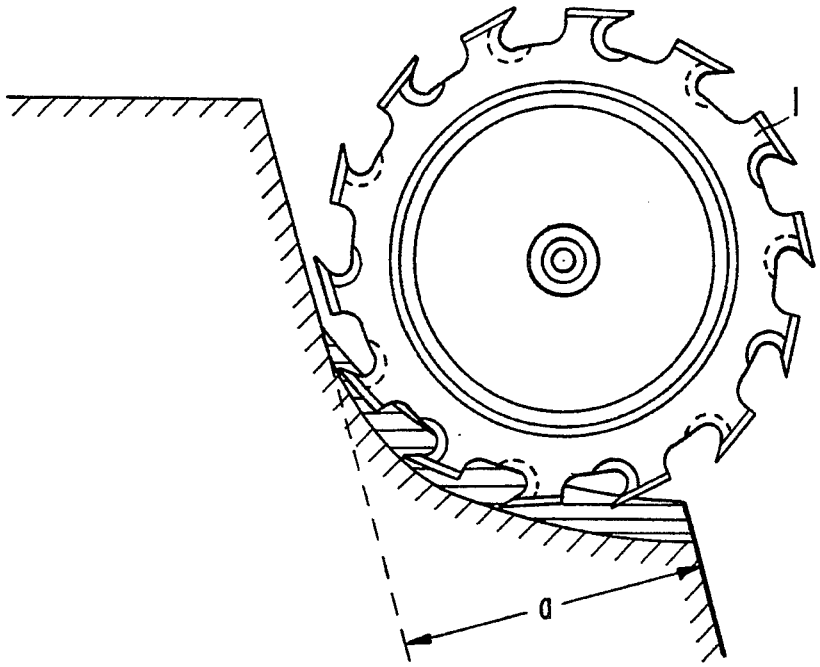
FIG. 1 is a basic sketch of a disc-shaped rotary cutter operating in a vertical plane.

FIG. 1 is a schematic representation of a disc-shaped rotary cutter 1 which operates in hard rock in a parallel or vertical plane. This type of excavation is particularly appropriate and advisable in layered or solid rock since, in contrast to a bench cut, no larger chunks are broken out at the cut end. At the same time, the material to be conveyed is broken up better since the; largest chip size lies at the beginning of the respective cut.

Figure 2:
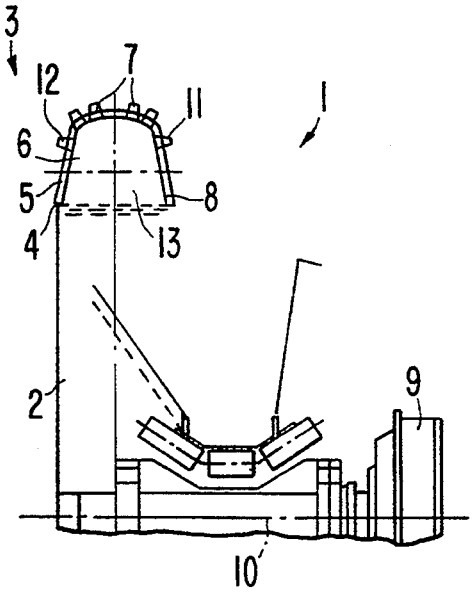
FIGS. 2 and 3 are different views of a disc-shaped rotary cutter and its drive.
Figure 3:
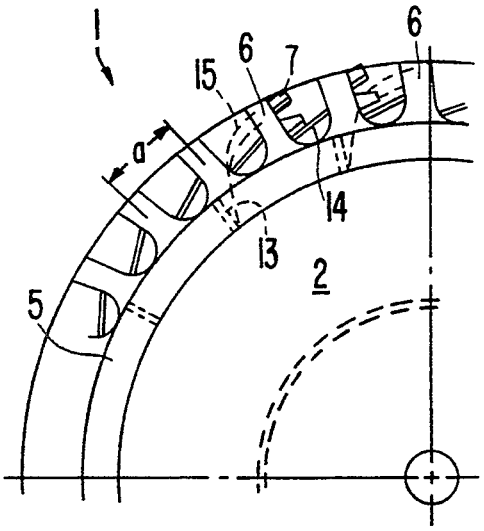

FIGS. 2 and 3 depict the disc-shaped rotary cutter 1 in various views. Rotary cutter 1 is composed of a carrier body 2 and an outer tool carrier 3 which cooperates with the carrier body. As a welded structure 4, they form the supporting element for rotary cutter 1. A ring carrier 5, a disc-shaped component (end face), is welded radially to tool carrier 3 and changes into the actual, arcuate cutting elements 6 (in the embodiment shown in FIG. 3, they number 32, while in the embodiment shown in FIG. 1, there are a total of 14) with teeth 7 welded thereunto. In the region of their free ends, cutting elements 6 change into a further, likewise disc-shaped ring carrier 8 (end face). Ring carriers 5, 8 and cutting elements 6 are here constructed of one piece so that a supporting component 3 is formed. The drive 9 for rotary cutter 1 is seated on the center axis 10 of rotary cutter 1 and is designed for an installed power of 0.35 kW per $m^3/h$ of theoretical conveying output. In the region of end faces 5, 8, there are provided further teeth 11, 12, the so-called side wings. Webs 13, extending approximately horizontally, are provided as reinforcements for the ring carriers 5, 8 forming the end faces. Depending on the structural size, these webs 13 may also be replaced by a box-shaped structure. In order to push large-size cut material out of the way, chunk deflectors 14 are disposed on the sides of cutting elements 6. Only indicated is the flexible configuration of the backs of the cutting edges in the form of pockets 15. Seen in the circumferential direction, cutting elements 6 have a relatively small pitch a, so that the cut material can be excavated in a relatively small size. The number of cutting elements 6, as already explained, is 32, with each cutting element 6 being equipped with four teeth 7.

We claim:

1. A rotary cutter for continuous excavation of hard mineral rock layers comprising:

a supporting element having a plurality of end faces; and a plurality of cutting elements formed on a circumference of the supporting element and the plurality of end faces, the supporting element being supported by a cantilever arm of an excavation device for operation in a vertical plane and coupled to a drive assembly producing an installed power of at least 0.3 kW per $m^3/h$ of theoretical conveying power; and at least 14 cutting elements, each cutting element having at least four teeth;

the rotary cutter providing a cylindrical compressive strength of equal to or greater than 20 MPa.

2. A rotary cutter according to claim 1, wherein the plurality of end faces includes a plurality of teeth.

3. A rotary cutter according to claim 1, wherein each cutting element is configured as a stirrup formed with the plurality of end faces.

4. A rotary cutter according to claim 1, wherein the cutting elements are separated by a predetermined distance along a circumference of the supporting element, and wherein at least one pocket for carrying material is provided between each pair of cutting elements.

5. A disc-shaped rotary cutter for continuous excavation of hard mineral rock layers comprising:

a supporting element, a radial axis, a circumference, and a plurality of end faces coupled to the circumference;

a drive mechanism, coupled to the supporting element along the radial axis of the supporting element, for providing at least 0.3 kW per $m^3/h$ of theoretical conveying power; and a plurality of arcuate cutting elements formed on the circumference of the supporting element and the plurality of end faces, wherein the rotary cutter provides a cylindrical compressive strength of equal to or greater than 20 MPa.

6. A rotary cutter according to claim 5, wherein the supporting element is supported by a cantilever arm of an excavation device for operation in a vertical plane and wherein each cutting element includes a plurality of teeth.

7. A rotary cutter according to claim 6, wherein the end faces include a plurality of teeth.

8. A rotary cutter according to claim 6, wherein the cutting elements are separated by a predetermined distance along the circumference of the supporting element, and wherein the at least one pocket for carrying material is provided between each pair of cutting elements.

* * * * *